US011417272B2

(12) United States Patent
Yang et al.

(10) Patent No.: US 11,417,272 B2
(45) Date of Patent: Aug. 16, 2022

(54) PIXEL CIRCUIT, DRIVING METHOD THEREOF AND DISPLAY DEVICE

(71) Applicant: BOE Technology Group Co., Ltd., Beijing (CN)

(72) Inventors: Ming Yang, Beijing (CN); Ning Cong, Beijing (CN); Han Yue, Beijing (CN); Can Zhang, Beijing (CN); Can Wang, Beijing (CN); Jiao Zhao, Beijing (CN); Angran Zhang, Beijing (CN); Minghua Xuan, Beijing (CN); Xiaochuan Chen, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 138 days.

(21) Appl. No.: 16/763,219

(22) PCT Filed: Nov. 1, 2019

(86) PCT No.: PCT/CN2019/115093
§ 371 (c)(1),
(2) Date: May 11, 2020

(87) PCT Pub. No.: WO2020/253029
PCT Pub. Date: Dec. 24, 2020

(65) Prior Publication Data

US 2021/0407408 A1 Dec. 30, 2021

(30) Foreign Application Priority Data

Jun. 17, 2019 (CN) ..... 201910522133.8

(51) Int. Cl.
*G09G 3/3233* (2016.01)
*G09G 3/00* (2006.01)
*G09G 3/3291* (2016.01)

(52) U.S. Cl.
CPC ..... *G09G 3/3233* (2013.01); *G09G 3/006* (2013.01); *G09G 3/3291* (2013.01); *G09G 2300/0861* (2013.01); *G09G 2320/0233* (2013.01)

(58) Field of Classification Search
CPC ..... G09G 3/3233; G09G 3/006; G09G 2300/0861; G09G 2320/0233; G09G 3/30–3291
See application file for complete search history.

(56) References Cited

U.S. PATENT DOCUMENTS

2008/0252504 A1* 10/2008 Jeong ..... H03M 1/1019 341/144
2015/0035813 A1* 2/2015 Lei ..... H03F 3/393 345/205

(Continued)

*Primary Examiner* — Roberto W Flores
(74) *Attorney, Agent, or Firm* — Arch & Lake LLP

(57) ABSTRACT

A pixel circuit and driving method are provided. The pixel circuit includes a light emitting device having a first terminal and a second terminal; a driving circuit, electrically connected to the first terminal of the light emitting device, for providing power to the light emitting device; a voltage comparator for generating a pulse width modulated signal having a duty cycle based on a data voltage and a reference voltage; an offset voltage detecting circuit, electrically connected to an output terminal of the voltage comparator, for detecting an input offset voltage of the voltage comparator; and a data voltage compensation circuit, electrically connected to the offset voltage detecting circuit, for compensating the data voltage according to the input offset voltage detected.

19 Claims, 13 Drawing Sheets

(56) References Cited

U.S. PATENT DOCUMENTS

| | | | | |
|---|---|---|---|---|
| 2016/0118971 | A1* | 4/2016 | Sugiyama | G09G 3/2074<br>341/158 |
| 2020/0020283 | A1* | 1/2020 | Chou | G09G 3/3291 |

* cited by examiner

PIXEL CIRCUIT, DRIVING METHOD THEREOF AND DISPLAY DEVICE

CROSS-REFERENCE TO RELATED APPLICATIONS

This application is the U.S. national phase of PCT Patent Application No. PCT/CN2019/115093 filed on Nov. 1, 2019, which claims the priority of Chinese Patent Application No. 201910522133.8, filed on Jun. 17, 2019, the entire content of both of which is incorporated herein by reference in their entirety for all purposes.

FIELD

The present disclosure relates to a pixel circuit, a driving method thereof, and a display device.

BACKGROUND

Compared with organic light emitting diodes (OLEDs), micro light emitting diodes (LEDs) have higher efficiency, lower power consumption and higher reliability; and they may become the new display products in the future.

A micro LED is a current driving device, and its brightness is related to the current flowing through it and the illumination time or light emitting duration. A voltage comparator controls the duty cycle of the square wave signal (e.g. the pulse width modulated signal) output to the micro LED by adjusting the relative voltage relationship between the non-inverting input voltage and the inverting input voltage, thereby controlling the lighting emitting duration of the micro LED. The input offset voltage is an important parameter of the voltage comparator. If the input offset voltage exists (i.e. the input offset voltage is not zero), the voltage comparator output changes from one logic level to the other when the non-inverting input voltage of the voltage comparator deviates from the inverting input voltage of the voltage comparator by a certain value (not equal to 0). The existence and non-uniformity of the input offset voltages in the voltage comparators may cause the following problem: when the same gray level is displayed, the light emitting durations of the pixel circuits at different positions of the display panel are different, so that the uniformity of the brightness of the display panel is poor, affecting the display. Here, the non-inverting input voltage refers to the voltage input to the non-inverting input terminal of the voltage comparator, and the inverting input voltage refers to the voltage that is input to the inverting input terminal of the voltage comparator.

SUMMARY

Embodiments of the present disclosure provide a pixel circuit, a driving method thereof, and a display device.

According to a first aspect of the present disclosure, there is provided a pixel circuit, including: a light emitting device having a first terminal and a second terminal; a driving circuit, electrically connected to the first terminal of the light emitting device, for providing power to the light emitting device; a voltage comparator for generating a pulse width modulated signal having a duty cycle based on a data voltage and a reference voltage; an offset voltage detecting circuit, electrically connected to an output terminal of the voltage comparator, for detecting an input offset voltage of the voltage comparator; and a data voltage compensation circuit, electrically connected to the offset voltage detecting circuit, for compensating the data voltage according to the input offset voltage detected.

According to a second aspect of the present disclosure, there is provided a driving method for a pixel circuit, the pixel circuit including a light emitting device having a first terminal and a second terminal; a driving circuit, electrically connected to the first terminal of the light emitting device, for providing power to the light emitting device; a voltage comparator for generating a pulse width modulated signal having a duty cycle based on a data voltage and a reference voltage; an offset voltage detecting circuit, electrically connected to an output terminal of the voltage comparator, for detecting an input offset voltage of the voltage comparator; and a data voltage compensation circuit, electrically connected to the offset voltage detecting circuit, for compensating the data voltage according to the input offset voltage detected, the driving method including: detecting the input offset voltage of the voltage comparator in a detection period; and compensating the data voltage according to the input offset voltage to obtain a compensated data voltage in a display period.

BRIEF DESCRIPTION OF DRAWINGS

A more particular description of the embodiments will be rendered by reference to specific embodiments illustrated in the appended drawings. Given that these drawings depict only some embodiments and are not therefore considered to be limiting in scope, the embodiments will be described and explained with additional specificity and details through the use of the accompanying drawings, in which.

DETAILED DESCRIPTION

Figure 1:
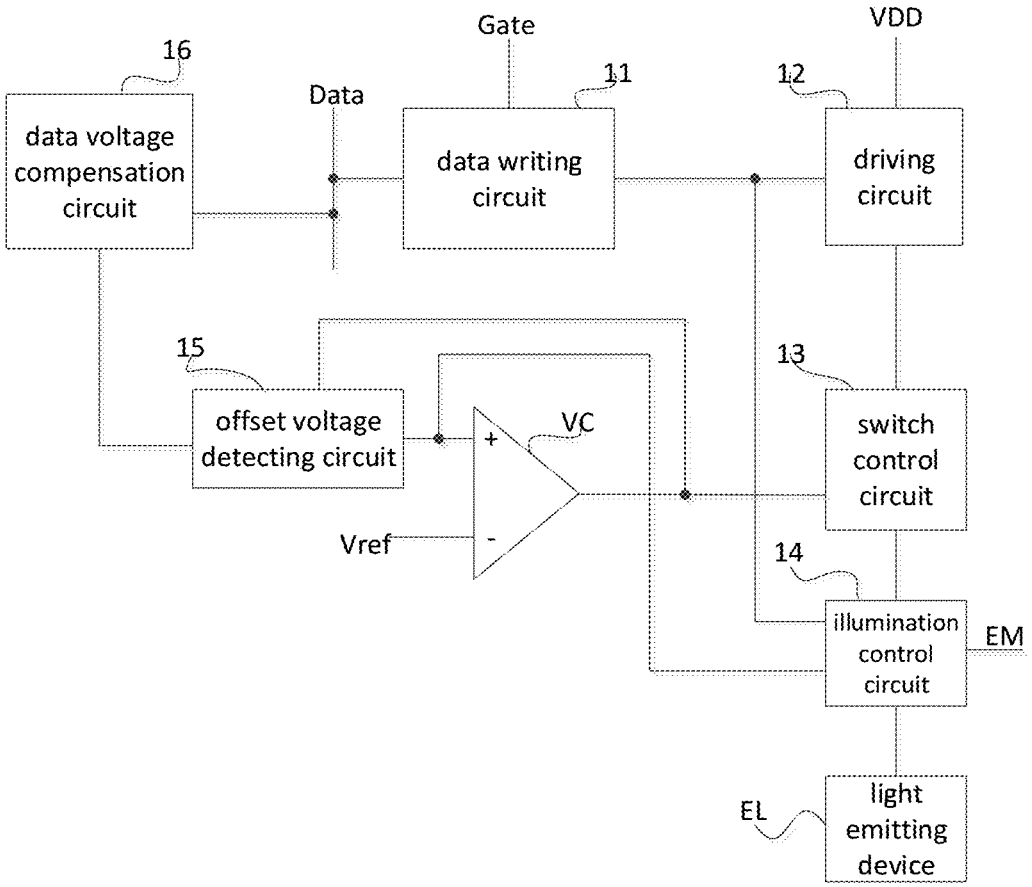
FIG. 1 is a structural diagram of a pixel circuit according to an embodiment.

The disclosure will be described hereinafter with reference to the accompanying drawings, which illustrate embodiments of the disclosure. The described embodiments are only exemplary embodiments of the present disclosure, but not all embodiments. Other variations may be derivable by a person of ordinary skill in the art based on the embodiments of the present disclosure without creative efforts, and are within the scope of the present disclosure.

References throughout the disclosure to "one embodiment", "an embodiment", "an example", "some embodiments", or similar language mean that a particular feature, structure, or characteristic described in connection with the embodiment is included in at least one embodiment. Thus, appearances of the phrases "in one embodiment", "in an embodiment", "in some embodiments", and similar language throughout the disclosure may, but do not necessarily, all refer to the same embodiment(s), but mean "one or more embodiments". These may or may not include all the embodiments disclosed. Accordingly, features or elements of some embodiments may be available in some other embodiments unless the context indicates otherwise.

Unless otherwise defined, technical terms or scientific terms used in the embodiments of the present disclosure should be construed in the ordinary meaning of the person of ordinary skill in the art.

The terms "first", "second" and similar terms used in the present disclosure do not denote any order, quantity, or importance. They are merely used for references to relevant devices, components, procedural steps, etc. These terms do not imply any spatial or chronological orders, unless expressly specified otherwise. For example, a "first device" and a "second device" may refer to two separately formed devices, or two parts or components of the same device. In some cases, for example, a "first device" and a "second device" may be identical, and may be named arbitrarily. Similarly, a "first step" of a method or process may be carried or performed before, after, or simultaneously with, a "second step".

The terms "comprising", "including", "having", and variations thereof mean "including but not limited to", unless expressly specified otherwise.

An enumerated listing of items does not imply that any or all of the items are mutually exclusive, unless expressly specified otherwise. The terms "a", "an", and "the" also refer to "one or more" unless expressly specified otherwise.

The words "connected" or "connection" and the like are not limited to physical or mechanical connections, but may include electrical connections, whether direct or indirect.

The steps illustrated in the flowcharts of the drawings may be executed by a computer system such as a set of computer executable instructions. Although logical sequences are shown in the flowcharts, in some cases, the steps shown or described may be performed in a different order than the ones described herein.

The drawings of the present disclosure relate only to structures involved in the present disclosure, and other structures may refer to the usual design.

The transistors employed in the embodiments of the present disclosure may be triodes, thin film transistors, field effect transistors or other devices having the same characteristics. In the embodiments, to distinguish the other two electrodes of the transistor besides the control electrode, one of the electrodes is referred to as the first electrode and the other electrode is referred to as the second electrode.

In actual operation, when the transistor is a triode, the control electrode may be a base, the first electrode may be a collector, and the second electrode may be an emitter; or the control electrode may be a base, the first electrode may be an emitter and the second electrode may be a collector.

In actual operation, when the transistor is a thin film transistor or a field effect transistor, the control electrode may be a gate, the first electrode may be a drain, and the second electrode may be a source; or the control electrode may be a gate, the first electrode may be a source, and the second electrode may be a drain.

A pixel circuit according to an embodiment of the present disclosure includes a light emitting device; a driving circuit for providing power to the light emitting device; a voltage comparator for generating a pulse width modulated signal having a duty cycle based on a data voltage and a reference voltage; an offset voltage detecting circuit for detecting an input offset voltage of the voltage comparator; and a data voltage compensation circuit for compensating the data voltage according to the input offset voltage detected.

The pixel circuit according to an embodiment of the present disclosure may further include a data writing circuit, a switch control circuit, and an illumination control circuit.

The data writing circuit is configured to control writing a data voltage provided on a data line to a control terminal of the driving circuit under the control of a gate driving signal input by a gate line, and to control a potential at the control terminal of the driving circuit.

The illumination control circuit is configured to control a connection between a second terminal of the switch control circuit and the light emitting device under the control of an illumination control signal input by an illumination control line, and to control a connection between the control terminal of the driving circuit and a first input terminal (e.g. the non-inverting input terminal) of the voltage comparator.

The switch control circuit is configured to control a connection between a first terminal of the switch control circuit and the second terminal of the switch control circuit under the control of a potential at its control terminal.

The driving circuit is configured to control a connection between a power supply voltage terminal and the first terminal of the switch control circuit under the control of a potential at the control terminal of the driving circuit.

A second input terminal (e.g. the inverting input terminal) of the voltage comparator is electrically connected to a reference voltage terminal; an output terminal of the voltage comparator is electrically connected to the control terminal of the switch control circuit; and the voltage comparator is configured to output a control voltage signal (e.g. the pulse width modulated signal) according to voltages input to the first input terminal and the reference voltage input to the second input terminal.

The pixel circuit according an embodiment of the present disclosure is provided with a detection period before a display period; and the display period includes a data writing phase. During the detection period, the offset voltage detecting circuit detects the input offset voltage of the voltage comparator. During the data writing phase, the data voltage compensation circuit compensates the data voltage according to the input offset voltage to obtain a compensated data voltage, so that the pixel circuit according to the embodiment of the present disclosure can accurately control the on and off of the switch control circuit through the voltage comparator, thereby enabling accurate adjustment of the illumination time of the light emitting device.

In the embodiment of the present disclosure, after detecting the input offset voltage of the voltage comparator included in each pixel circuit, and performing data voltage compensation on each pixel circuit according to the corresponding input offset voltage, the light emitting durations of the pixel circuits at different positions are the same when the same gray scale is displayed. Thus, the uniformity of the brightness of the display panel is increased, and the display effect is improved.

The light emitting device may be a micro LED (micro light emitting diode).

In an embodiment of the present disclosure, the first input terminal of the voltage comparator may be the non-inverting input terminal, and the second input terminal of the voltage comparator may be the inverting input terminal; or the first input terminal of the voltage comparator may be the inverting input terminal, and the second input terminal of the voltage comparator may be the non-inverting input terminal.

As shown in FIG. 1, the pixel circuit according to an embodiment of the present disclosure includes a light emitting device or a light emitting element EL, a driving circuit 12 for providing power to the light emitting device, a voltage comparator VC for generating a pulse width modulated signal based on a data voltage and a reference voltage to control the illumination time of the light emitting device, an offset voltage detecting circuit 15 for detecting an input offset voltage of the voltage comparator; and a data voltage compensation circuit 16 for compensating the data voltage according to the input offset voltage detected. The pixel circuit further includes a data writing circuit 11, a switch control circuit 13, and an illumination control circuit 14.

The data writing circuit 11 is electrically connected to a gate line Gate, a data line Data, and a control terminal of the driving circuit 12, respectively. The data writing circuit 11 is configured to control the writing of the data voltage provided by the data line Data to the control terminal of the driving circuit 12 under the control of a gate driving signal input by the gate line Gate, and is configured to control the potential at the control terminal of the driving circuit 12.

The driving circuit 12 is electrically connected to a power supply voltage terminal and a first terminal of the switch control circuit 13 respectively, for controlling the connection between the power supply voltage terminal and the first terminal of the switch control circuit 13 under the control of the potential at the control terminal of the driving circuit 12. The power supply voltage terminal is used to input the power voltage VDD.

The illumination control circuit 14 is electrically connected to the illumination control line EM, a second terminal of the switch control circuit 13, the light emitting element EL, the control terminal of the driving circuit 12, and a first input terminal (e.g. the non-inverting input terminal) of the voltage comparator VC, respectively. The illumination control circuit 14 is configured to control the connection between the second terminal of the switch control circuit 13 and the light emitting element EL under control of an illumination control signal input by the illumination control line EM, and control the connection between the control terminal of the driving circuit 12 and the first input terminal of the voltage comparator VC.

The switch control circuit 13 is configured to control the connection between the first terminal of the switch control circuit 13 and the second terminal of the switch control circuit 13 under the control of the potential at the control terminal thereof.

A second input terminal (e.g. the inverting input terminal) of the voltage comparator VC is electrically connected to a reference voltage terminal; an output terminal of the voltage comparator VC is electrically connected to the control terminal of the switch control circuit 13; and the voltage comparator VC outputs a control voltage signal according to the voltage at the first input terminal and the reference voltage Vref at the second input terminal. The reference voltage terminal is used to input the reference voltage Vref.

The offset voltage detecting circuit 15 is electrically connected to the first input terminal (e.g. the non-inverting input terminal) of the voltage comparator VC and the output terminal of the voltage comparator VC, respectively, for detecting the input offset voltage of the voltage comparator VC.

The data voltage compensation circuit 16 is electrically connected to the offset voltage detecting circuit 15 and the data line Data, respectively, for compensating the data voltage according to the input offset voltage to obtain the compensated data voltage. The compensated data voltage is supplied to the data line Data. For example, the data voltage compensation circuit 16 may be an application specific integrated circuit, or it may include programmable logic arrays or microcontrollers appropriately programmed or other hardware devices that obtain the compensated data voltage according to the input offset voltage and supply the compensated data voltage to the data line.

In the pixel circuit shown in FIG. 1, the first input terminal of the voltage comparator VC is the non-inverting input terminal, and the second input terminal of the voltage comparator VC is the inverting input terminal. The present disclosure does not limit this.

In the embodiment, the pixel circuit shown in FIG. 1 is provided with a detection period before a display period; and the display period includes a data writing phase and an illumination phase which are sequentially configured.

During the detection period, the offset voltage detecting circuit 15 detects the input offset voltage of the voltage comparator VC. The data writing circuit 11 controls the data line Data to be disconnected from the control terminal of the driving circuit 12 under the control of the gate driving signal; and the illumination control circuit 14 controls the second terminal of the switch control circuit 13 to be disconnected from the light emitting element EL under the control of the illumination control signal, and controls the control terminal of the driving circuit 12 to be disconnected from the first input terminal of the voltage comparator VC.

In the data writing phase, the data voltage compensation circuit 16 compensates the data voltage according to the input offset voltage to obtain the compensated data voltage. The data writing circuit 11, under the control of the gate driving signal, writes the compensated data voltage to the control terminal of the driving circuit 12 and controls the potential at the control terminal of the driving circuit 12.

In the illumination phase or the light emitting phase, the offset voltage detecting circuit 15 stops detecting the input offset voltage of the voltage comparator VC. The reference voltage terminal inputs the reference voltage Vref, and the driving circuit 12 controls the connection between the power supply voltage terminal and the first terminal of the switch control circuit 13 under the control of the potential at the control terminal of the driving circuit 12. The illumination control circuit 14 controls the connection between the second terminal of the switch control circuit 13 and the light emitting element EL under the control of the illumination control signal input by the illumination control line EM, and controls the connection between the control terminal of the driving circuit 12 and the first input terminal of the voltage comparator VC. The voltage comparator VC outputs the control voltage signal according to the voltage at the first input terminal and the reference voltage Vref. The switch control circuit 13 controls the connection between the first terminal of the switch control circuit 13 and the second terminal of the switch control circuit 13 under the control of the control voltage signal outputted by the voltage comparator VC to control the illumination time of the light emitting element EL.

In the embodiment, in the light emitting phase, the current value flowing through the light emitting element EL is related to the compensated data voltage, and the illumination time of the light emitting element EL is related to Vref and the compensated data voltage.

In a display device including a plurality of pixel circuits according to the embodiment, after detecting the input offset voltage of the voltage comparator included in each pixel circuit, and performing data voltage compensation on each pixel circuit according to the corresponding input offset voltage, the light emitting durations of the pixel circuits at different positions of the display device are the same when the same gray scale is displayed. Thus, the uniformity of the brightness of the display panel is increased, and the display effect is improved.

In an embodiment, the offset voltage detecting circuit may include a test voltage supplying circuit and a detection circuit.

The test voltage supplying circuit is configured to provide a DC test voltage to the first input terminal of the voltage comparator; and the detection circuit is configured to detect output voltages outputted by the output terminal of the voltage comparator when the test voltage supplying circuit supplies the DC test voltage to the first input terminal and the reference voltage is provided to the second input terminal, and obtain the input offset voltage of the voltage comparator.

Figure 2:
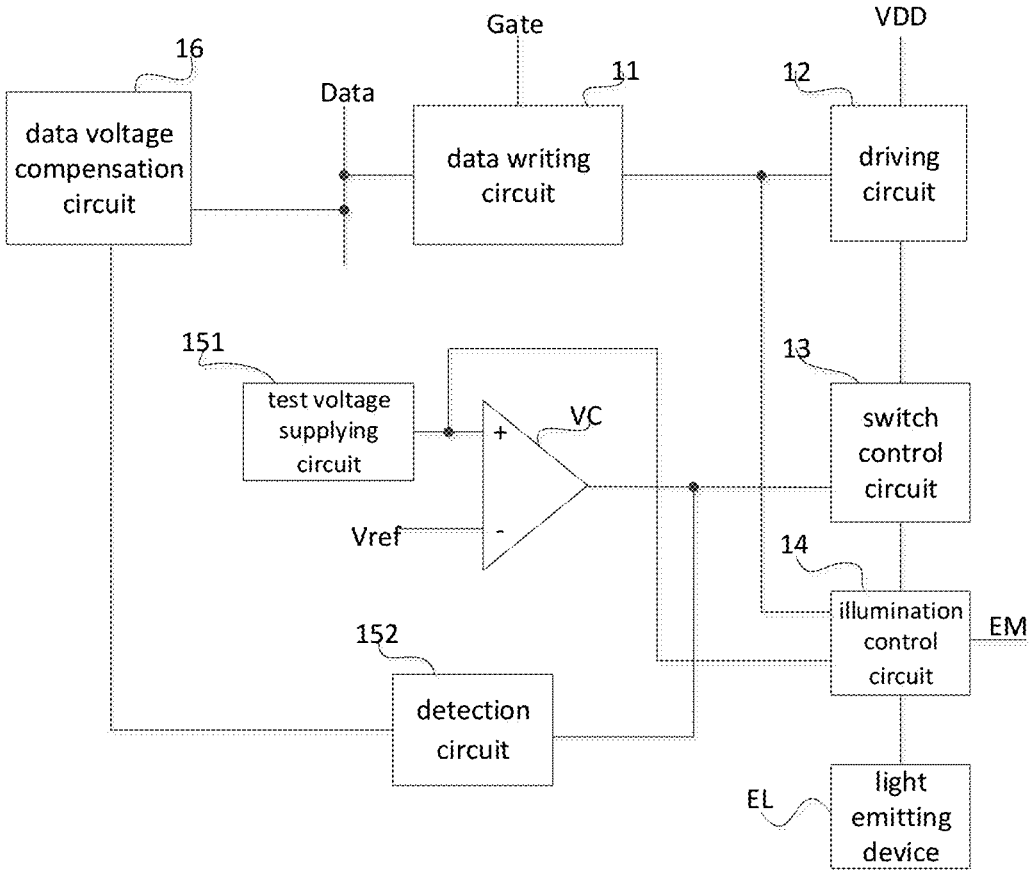
FIG. 2 is a structural diagram of a pixel circuit according to an embodiment.

In the pixel circuit shown in FIG. 2, the offset voltage detecting circuit may include a test voltage supplying circuit 151 and a detection circuit 152.

The test voltage supplying circuit 151 is electrically connected to the non-inverting input terminal of the voltage comparator VC for providing a DC test voltage to the non-inverting input terminal of the voltage comparator VC.

The detection circuit 152 is electrically connected to the output terminal of the voltage comparator VC and the data voltage compensation circuit 16, respectively, for detecting output voltages outputted by the output terminal of the voltage comparator VC when the test voltage supplying circuit 151 supplies the DC test voltage to the non-inverting input terminal and the reference voltage is provided to the inverting input terminal, obtaining the input offset voltage of the voltage comparator, and providing the input offset voltage to the data voltage compensation circuit 16.

The offset voltage detecting circuit 15 obtains the input offset voltage of the voltage comparator VC according to the outputs voltages of the voltage comparator VC as follows: the detection circuit 152 determines a voltage difference between the first input terminal of the voltage comparator VC and the second input terminal of the voltage comparator VC as the input offset voltage of the voltage comparator VC when the output voltage of the voltage comparator VC is a predetermined voltage; and the predetermined voltage may be (VH+VL)/2, where VH is a high voltage output by the voltage comparator VC and VL is a low voltage output by the voltage comparator VC.

In an embodiment, the first input terminal of the voltage comparator may be the non-inverting input terminal, and the second input terminal of the voltage comparator may be the inverting input terminal; and the voltage difference between the DC test voltage (i.e. the voltage at the non-inverting input terminal) and the reference voltage (i.e. the voltage at the inverting input terminal) is within a first predetermined voltage difference range.

In an embodiment, the first input terminal of the voltage comparator may be the inverting input terminal, and the second input terminal of the voltage comparator may be the non-inverting input terminal; and the voltage difference between the reference voltage and the DC test voltage is within a second predetermined voltage difference range.

In an example, the first predetermined voltage difference range and the second predetermined voltage difference range may be in the range of −2V to 2V. The present disclosure does not limit this.

In an embodiment, the test voltage supplying circuit may include a voltage supply switching sub-circuit configured to control a connection between the test voltage terminal and the first input terminal of the voltage comparator under control of a test control signal input by the test control terminal.

The voltage supply switching sub-circuit controls whether to output the DC test voltage to the first input terminal of the voltage comparator.

The voltage supply switching sub-circuit may include a voltage supply switching transistor. The control electrode of the voltage supply switching transistor is electrically connected to the test control terminal; the first electrode of the voltage supply switching transistor is electrically connected to the test voltage terminal; and the second electrode of the voltage supply switching transistor is electrically connected to the first input terminal of the voltage comparator.

In an embodiment, the test voltage supplying circuit may further include a voltage supplying sub-circuit for providing the DC test voltage to the test voltage terminal.

In an embodiment, the detection circuit may include a detection switching sub-circuit for controlling a connection between the output terminal of the voltage comparator and the read line under control of a detection switching control signal input by a detection switching control terminal.

The detection switching sub-circuit may include a detection switching transistor. The control electrode of the detection switching transistor is electrically connected to the detection switching control terminal; the first electrode of the detection switching transistor is electrically connected to the read line; and the second electrode of the detection switching transistor is electrically connected to the output terminal of the voltage comparator.

In an embodiment, the detection circuit may further include a detection sub-circuit electrically connected to the read line for obtaining the input offset voltage of the voltage comparator based on the output voltages outputted by the output terminal of the voltage comparator.

The detection switching sub-circuit controls whether the voltage comparator outputs voltages to the detection sub-circuit.

In an embodiment, the data voltage compensation circuit is configured to add the input offset voltage to the data voltage to obtain the compensated data voltage, and supply the compensated data voltage to the data line. The data voltage compensation circuit adds the offset voltage to the raw data voltage in order to compensate the data voltage.

Figure 3:
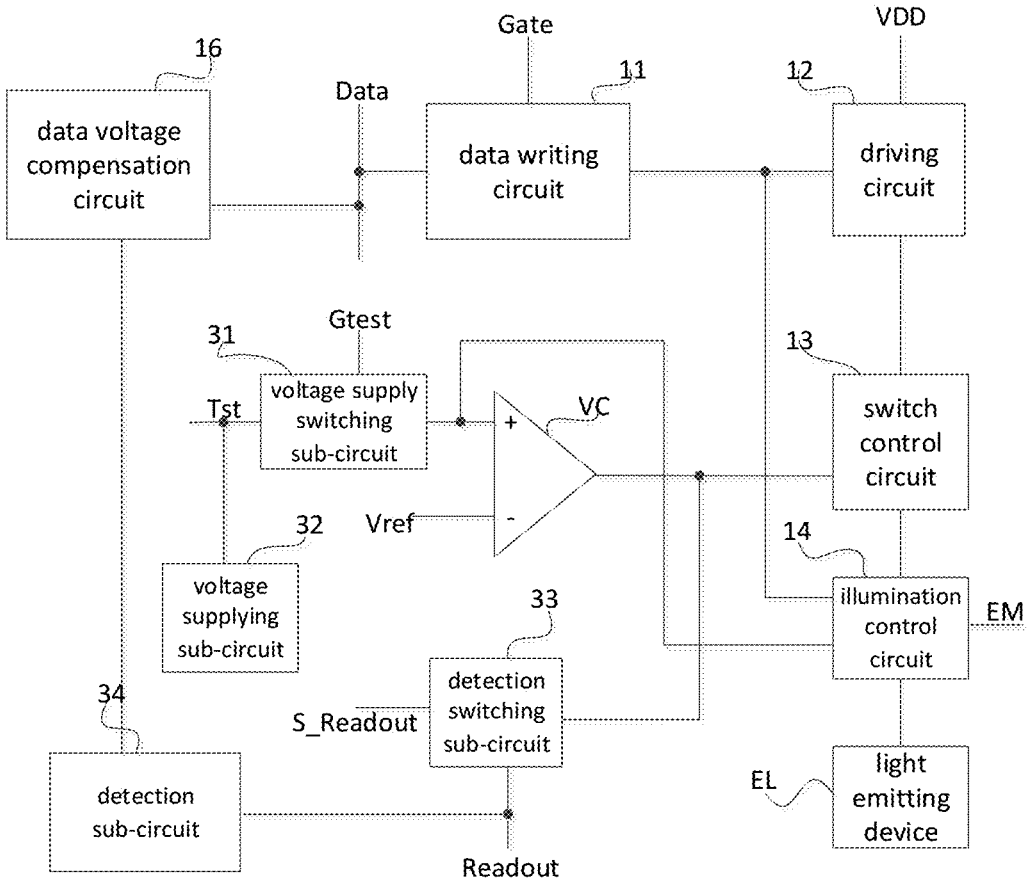
FIG. 3 is a structural diagram of a pixel circuit according to an embodiment.

In the pixel circuit shown in FIG. 3, the test voltage supplying circuit may include a voltage supply switching sub-circuit 31 and a voltage supplying sub-circuit 32. The voltage supply switching sub-circuit 31 is electrically connected to a test control terminal Gtest, a test voltage terminal Tst and the non-inverting input terminal of the voltage comparator VC, respectively, for controlling the connection between the test voltage terminal Tst and the non-inverting input terminal of the voltage comparator VC under the control of the test control signal input by the test control terminal Gtest. The voltage supplying sub-circuit 32 is electrically connected to the test voltage terminal Tst for providing a DC test voltage to the test voltage terminal Tst.

The detection circuit may include a detection switching sub-circuit 33 and a detection sub-circuit 34. The detection switching sub-circuit 33 is electrically connected to a detection switching control terminal S_Readout, the output terminal of the voltage comparator VC, and a read line Readout, respectively, for controlling the connection between the output terminal of the voltage comparator VC and the read line Readout under the control of a detection switching control signal input by the detection switching control terminal S_Readout.

The detection sub-circuit 34 is electrically connected to the read line Readout and the data voltage compensation circuit 16, respectively, for obtaining the input offset voltage of the voltage comparator VC according to voltages outputted by the output terminal of the voltage comparator VC and supplying the input offset voltage to the data voltage compensation circuit 16.

In an embodiment, the switch control circuit may include a switch control transistor, and the illumination control circuit may include a first illumination control transistor and a second illumination control transistor.

The control electrode of the switch control transistor is electrically connected to the output terminal of the voltage comparator; the first electrode of the switch control transistor is electrically connected to the driving circuit; and the second electrode of the switch control transistor is electrically connected to the first electrode the second illumination control transistor.

The control electrode of the first illumination control transistor is electrically connected to the illumination control line; the first electrode of the first illumination control transistor is electrically connected to the control terminal of the driving circuit; and the second electrode of the first illumination control transistor is electrically connected to the first input terminal of the voltage comparator.

The control electrode of the second illumination control transistor is electrically connected to the illumination control line, and the second electrode of the second illumination control transistor is electrically connected to the light emitting device.

In an embodiment, the data writing circuit may include a data writing transistor and a storage capacitor, and the driving circuit may include a driving transistor.

The control electrode of the data writing transistor is electrically connected to the gate line; the first electrode of the data writing transistor is electrically connected to the data line, and the second electrode of the data writing transistor is electrically connected the control electrode of the driving transistor.

The first terminal of the storage capacitor is electrically connected to the control electrode of the driving transistor, and the second terminal of the storage capacitor is electrically connected to a first voltage terminal.

The control electrode of the driving transistor is the control terminal of the driving circuit; the first electrode of the driving transistor is electrically connected to a power supply voltage terminal; and the second electrode of the driving transistor is electrically connected to the first terminal of the switch control circuit.

In an example, the first voltage terminal may be a low voltage terminal or a ground terminal, but it is not limited thereto.

Figure 4:
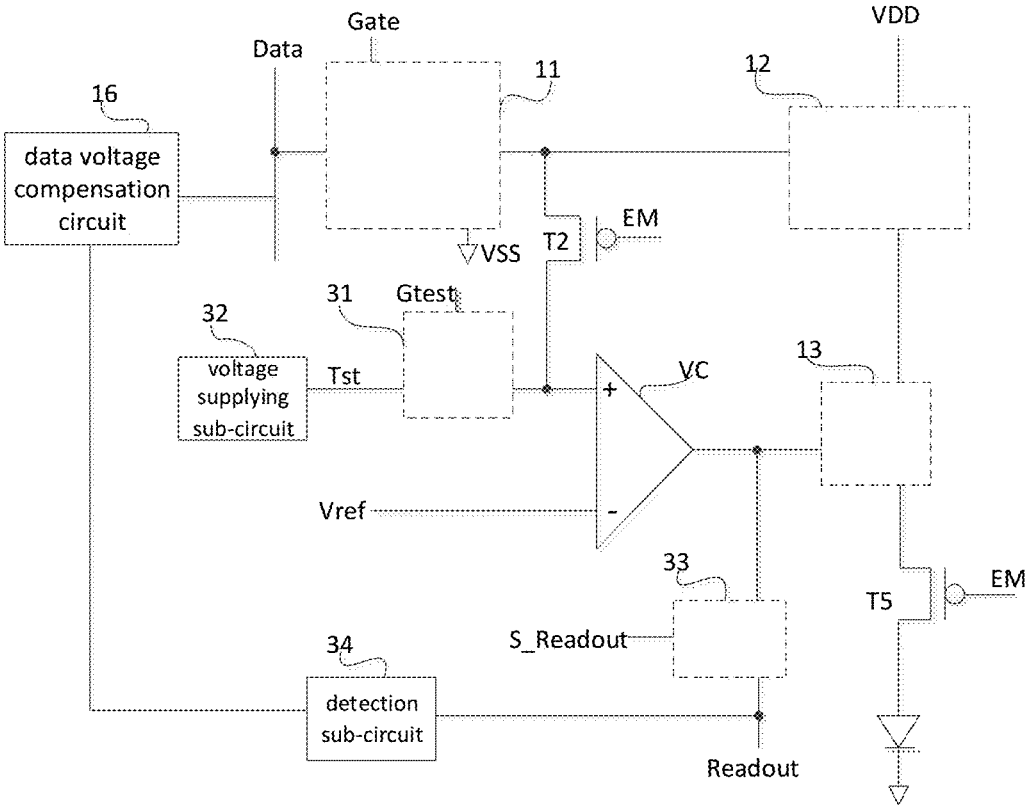
FIG. 4 is a structural diagram of a pixel circuit according to an embodiment.

In an embodiment shown in FIG. 4, the pixel circuit includes a micro LED MLED, a data writing circuit 11, a driving circuit 12, a voltage comparator VC, a switch control circuit 13, an illumination control circuit, an offset voltage detecting circuit and a data voltage compensation circuit 16.

The inverting input terminal of the voltage comparator VC is electrically connected to the reference voltage terminal, and the reference voltage terminal is used for inputting the reference voltage Vref.

The offset voltage detecting circuit includes a test voltage supplying circuit and a detection circuit.

The test voltage supplying circuit includes a voltage supply switching sub-circuit 31 and a voltage supplying sub-circuit 32; and the voltage supply switching sub-circuit 31 includes a voltage supply switching transistor T6. The gate of the voltage supply switching transistor T6 is electrically connected to the test control terminal Gtest; the drain of the voltage supply switching transistor T6 is electrically connected to the test voltage terminal Tst; and the source of the voltage supply switching transistor T6 is electrically connected to the non-inverting input terminal of the voltage comparator VC. The voltage supplying sub-circuit 32 is electrically connected to the test voltage terminal Tst for providing a DC test voltage to the test voltage terminal Tst.

The detection circuit includes a detection switching sub-circuit 33 and a detection sub-circuit 34; and the detection switching sub-circuit 33 includes a detection switching transistor T7. The gate of the detection switching transistor T7 is electrically connected to the detection switching control terminal S_Readout; the drain of the detection switching transistor T7 is electrically connected to the read line Readout, and the source of the detection switching transistor T7 is electrically connected to the output terminal of the voltage comparator VC. The detection sub-circuit 34 is electrically connected to the read line Readout and the data voltage compensation circuit 16, respectively, for obtaining the input offset voltage of the voltage comparator VC based on the output voltages outputted by the output terminal of the voltage comparator and providing the input offset voltage to the data voltage compensation circuit 16.

The switch control circuit 13 includes a switch control transistor T4; the illumination control circuit includes a first illumination control transistor T2 and a second illumination control transistor T5; the data write circuit 11 includes a data writing transistor T1 and a storage capacitor C1; and the driving circuit 12 includes a driving transistor T3.

The gate of the switch control transistor T4 is electrically connected to the output terminal of the voltage comparator VC; the source of the switch control transistor T4 is electrically connected to the drain of the driving transistor T3, and the drain of the switch control transistor T4 is electrically connected to the source of the second illumination control transistor T5.

The gate of the first illumination control transistor T2 is electrically connected to the illumination control line EM; the source of the first illumination control transistor T2 is electrically connected to the gate of the driving transistor T3, and the drain of the first illumination control transistor T2 is electrically connected to the non-inverting input terminal of the voltage comparator VC.

The gate of the second illumination control transistor T5 is electrically connected to the illumination control line EM; the drain of the second illumination control transistor T5 is electrically connected to the anode of the MLED; and the cathode of the MLED is connected to a low voltage VSS.

The gate of the data writing transistor T1 is electrically connected to the gate line Gate; the source of the data writing transistor T1 is electrically connected to the data line Data; and the drain of the data writing transistor T1 is electrically connected to the gate of the driving transistor T3.

The first terminal of the storage capacitor C1 is electrically connected to the gate of the driving transistor T3, and the second terminal of the storage capacitor C1 is connected to the low voltage VSS.

The source of the driving transistor T3 is electrically connected to the power supply voltage terminal; the drain of the driving transistor T3 is electrically connected to the source of the switch control transistor T4; and the power supply voltage terminal is used for inputting the power supply voltage VDD.

The data voltage compensation circuit 16 is electrically connected to the offset voltage detecting circuit 15 and the data line Data, respectively, for compensating the data voltage according to the input offset voltage to obtain the compensated data voltage to be supplied to the data line Data.

In the above embodiment shown in FIG. 4, all of the transistors are p-type transistors. The present disclosure does not limit this.

Figure 5:
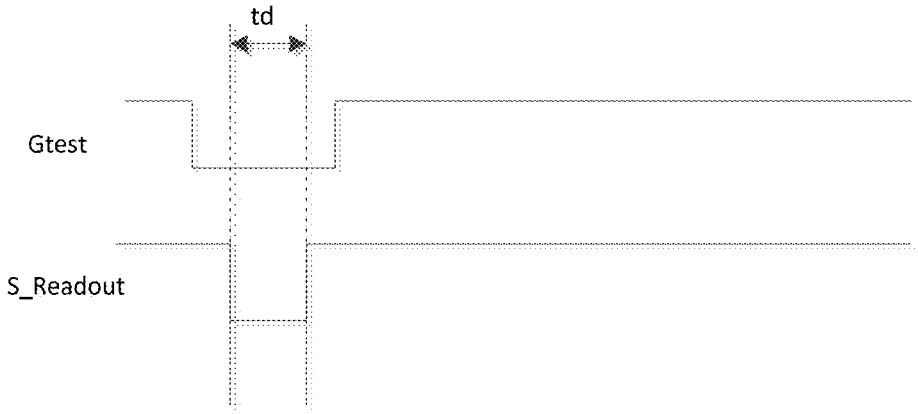
FIG. 5 is an operation timing chart of a pixel circuit according to an embodiment.

FIG. 5 is an operation timing chart of the pixel circuit shown in FIG. 4 when the pixel circuit is in operation. During the detection period td, both Gtest and S_Readout are input with a low level, and both the voltage supply switching transistor T6 and the detection switching transistor T7 are turned on. The test voltage terminal Tst is input with the corresponding DC test voltage Vtest, which is supplied to the non-inverting input terminal of the voltage comparator VC through the voltage supply switching transistor T6. The voltage comparator VC compares Vtest and Vref, and generates output voltages to be supplied to Readout through its output terminal and the turned-on detection switching transistor T7. The input offset voltage of the voltage comparator VC is obtained according to the voltages outputted by the voltage comparator VC. During the detection period td, the test voltage Vtest is changed a plurality of times to obtain a plurality of sets of the voltages Vout outputted by the voltage comparators VC, and the input offset voltage is obtained by plotting a voltage transfer curve.

When the difference between the potential at the non-inverting input terminal of the voltage comparator VC and the potential at the inverting input terminal of the voltage comparator VC is greater than the input offset voltage of the voltage comparator VC, the voltage comparator VC outputs a high voltage VH; when the difference between the potential at the non-inverting input terminal and the potential at the inverting input terminal is less than the input offset voltage, the voltage comparator VC outputs a low voltage VL; therefore, theoretically, when it is determined that the voltage comparator VC outputs a voltage of (VH+VL)/2, the difference between the potential at the non-inverting terminal and the potential at the inverting input is the input offset voltage of the voltage comparator VC.

During the detection period td, the transistors T1, T3, T2 and T5 in FIG. 4 are all turned off.

Moreover, when the duration of low level input to the S_readout is greater than the duration of low level input to the Gtest, the input offset voltage may be obtained more accurately.

When the pixel circuit shown in FIG. 4 is in operation, after the detection period, the pixel circuit performs normal display, and the display period may include the data writing phase and the illumination phase which are set sequentially.

In the data writing phase, the data voltage compensation circuit 16 compensates the data voltage according to the input offset voltage (e.g. adding the detected input offset voltage to the data voltage provided by the source driver to obtain the compensated data voltage), and supplies the compensated data voltage to the data line Data; under the control of the gate driving signal input by the gate line Gate, the data writing transistor T1 is turned on to write the compensated data voltage to the gate of the driving transistor T3, and the storage capacitor C1 is charged to control the potential at the gate of the driving transistor T3.

In the illumination phase, under the control of the gate driving signal input by the gate line Gate, the data writing transistor T1 is turned off; under the control of the illumination control signal input by the EM, the first illumination control transistor T2 and the second illumination control transistor T5 are turned on, and the gate of the driving transistor T3 is connected to the non-inverting input terminal of the voltage comparator VC. By changing Vref to control the voltage comparator VC to output different voltage signals, the switch control transistor T4 may be controlled to turn on or off to control the illumination time of the MLED.

In view of the input offset voltage of the voltage comparator, the pixel circuit according to the embodiments of the present disclosure is provided to improve the uniformity of the brightness of the display panel and improve the display effect.

Figure 6:
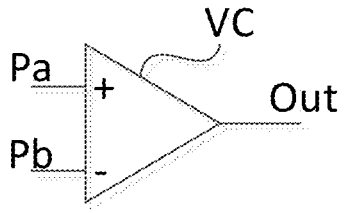
FIG. 6 is a schematic diagram of a voltage comparator VC.

FIG. 6 shows a schematic diagram of the voltage comparator VC, which includes a non-inverting input terminal Pa, an inverting input terminal Pb, and an output terminal Out.

Figure 7:
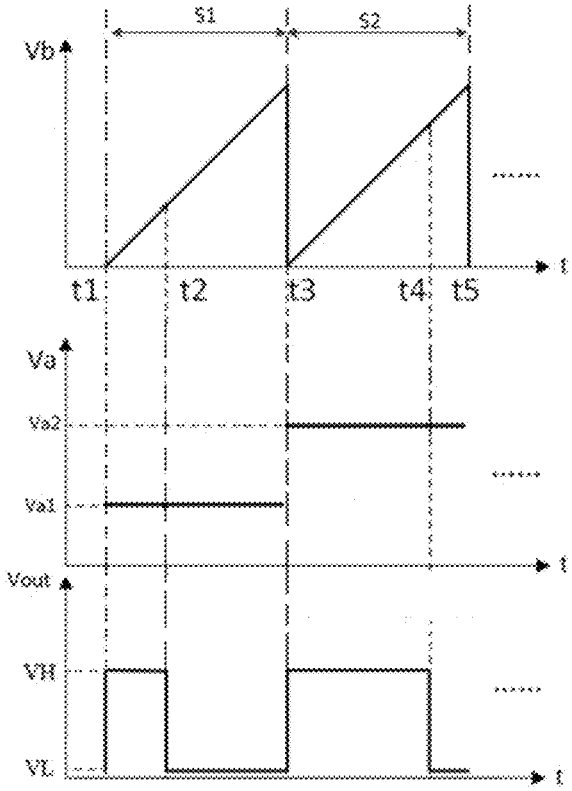
FIG. 7 is a diagram illustrating an input/output relationship of the voltage comparator VC in FIG. 6.

FIG. 7 is a diagram illustrating an input/output relationship of the voltage comparator VC in FIG. 6. The vertical axes represent voltages and the horizontal axes represent time t.

As shown in FIG. 7, it is assumed that the input offset voltage of the voltage comparator VC is 0. Va is the potential at the non-inverting input terminal of the voltage comparator VC, Vb is the potential at the inverting input terminal of the voltage comparator VC, and Vout is the voltage outputted by the voltage comparator VC through its output terminal.

In the first time period S1, a first DC voltage Va1 is input to the non-inverting input terminal Pa, and a first triangular wave signal Vb1 is input to the inverting input terminal Pb. In the first time period S1, while Vb1 increases from the minimum voltage value to the maximum voltage value, Va1 is greater than Vb1 from the first point in time t1 to the second point in time t2, and the voltage comparator VC outputs a high voltage VH through its output terminal Out, that is, Vout is VH; from the second point in time t2 to the third point in time t3, Va1 is smaller than Vb1, and the voltage comparator VC outputs a low voltage VL through its output terminal Out, that is, Vout is VL.

In the second time period S2, a second DC voltage Va2 is input to the non-inverting input terminal Pa, and a second triangular wave signal Vb2 is input to the inverting input terminal Pb. In the second time period S2, while Vb2 increases from the minimum voltage value to the maximum voltage value, from the third point in time t3 to the fourth point in time t4, Va2 is greater than Vb2, and the voltage comparator VC outputs the high voltage VH through its output terminal Out, that is, Vout is VH; from the fourth point in time t4 to the fifth point in time t5, Va2 is smaller than Vb2, and the voltage comparator VC outputs a low voltage VL through its output terminal Out, that is, Vout is VL.

In actual operation, by adjusting Va and/or Vb, the duty cycle of the pulse width modulated signal (i.e. the square wave signal) outputted by the voltage comparator can be adjusted. Therefore, the illumination time of the micro LED can be adjusted.

Due to the non-uniformity of the semiconductor manufacturing process, the device performance of the voltage comparators in the pixel circuits at different positions of the display panel, especially the input offset voltage, is different. The input offset voltage may be defined as the difference between the voltage at Pa and the voltage at Pb when the output voltage of the voltage comparator is the average value of VH and VL (i.e. the average value is equal to (VH+VL)/2). The input offset voltage of the voltage comparator can be obtained by plotting the voltage transfer curve of the voltage comparator.

Figure 8A:
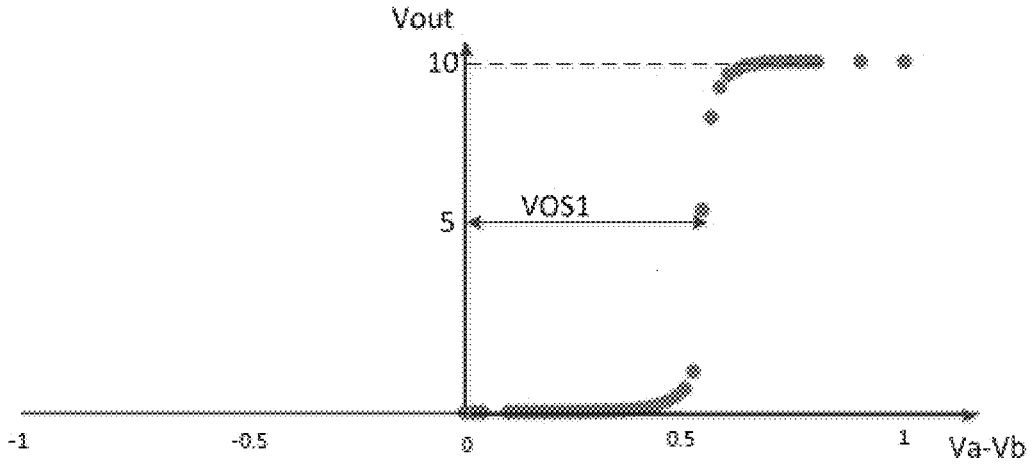
FIG. 8*a* is a voltage transfer curve of a voltage comparator at a position on a glass substrate.
Figure 8B:
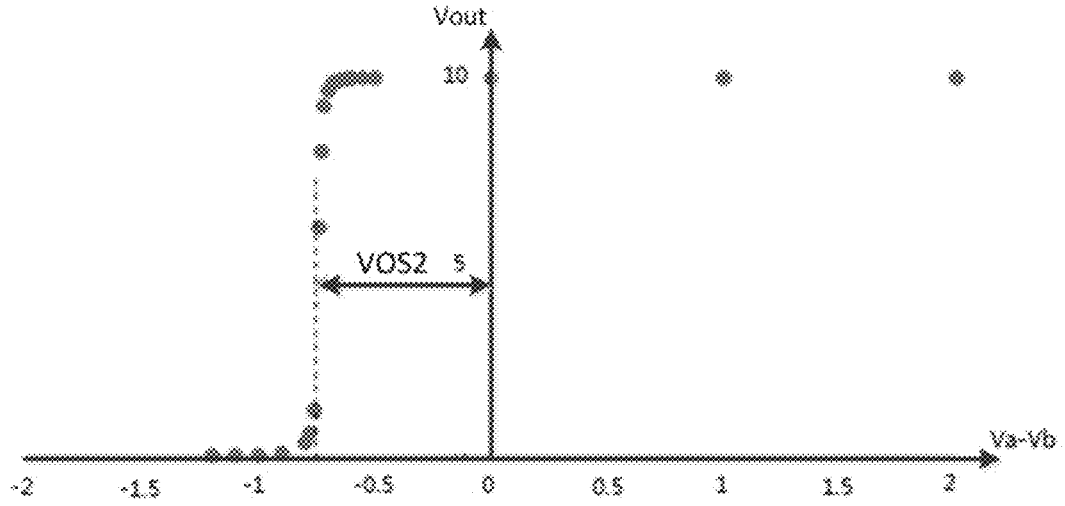
FIG. 8*b* is a voltage transfer curve of a voltage comparator at another position on the same glass substrate.

FIG. 8*a* and FIG. 8*b* are the voltage transfer curves of the voltage comparators at two positions on the same glass substrate. The horizontal axes represent Va-Vb, and the unit is V (volt); the vertical axes represent Vout, and the unit is V (volt). It can be found that the input offset voltages of the two voltage comparators are different; and the input offset voltage VOS1 of the voltage comparator corresponding to FIG. 8*a* (i.e. sample 1) is a positive value, and the input offset voltage VOS2 of the voltage comparator corresponding to FIG. 8*b* (i.e. sample 2) is a negative value.

The voltage transfer curve in FIG. 8*a* shows that when Va-Vb is greater than VOS1, the output voltage Vout of the sample 1 voltage comparator is high; and the voltage transfer curve in FIG. 8*b* shows that when Va-Vb is greater than VOS2, the output voltage Vout of the sample 2 voltage comparator is high, where Va is the potential at the non-inverting input terminal of the voltage comparator and Vb is the potential at the inverting input terminal of the voltage comparator.

Figure 9A:
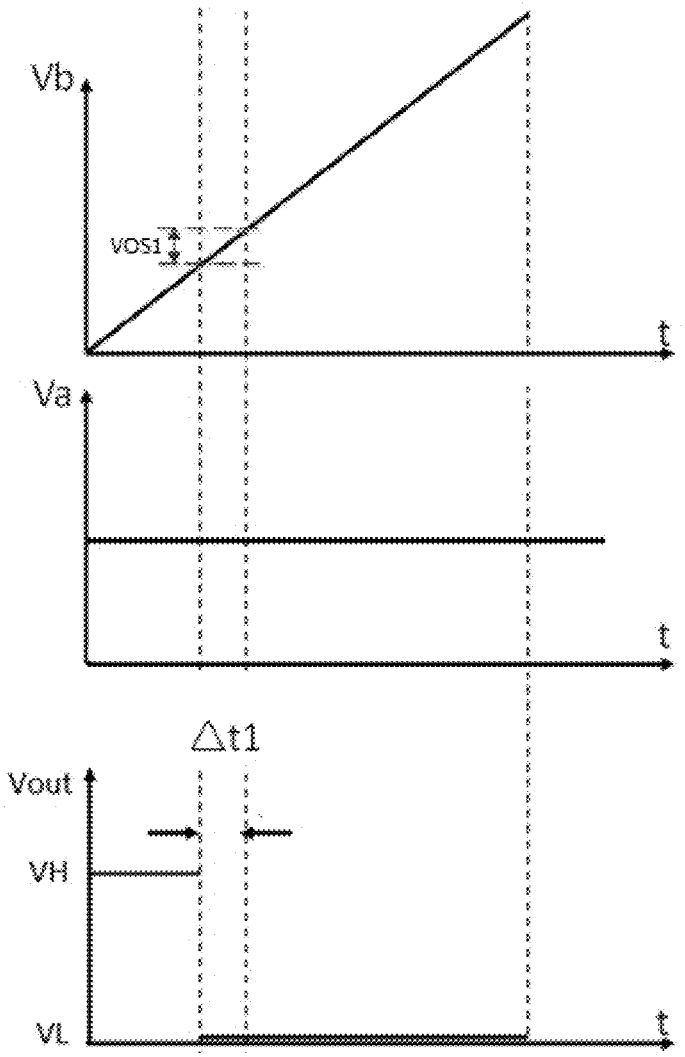
FIG. 9*a* is a schematic diagram illustrating an input offset voltage of the voltage comparator whose voltage transfer curve is shown in FIG. 8*a;*

As shown in FIG. 9*a*, for the voltage comparator corresponding to FIG. 8*a* (i.e. sample 1), VOS1 is greater than 0, and Vout is the high voltage VH when Va-Vb is greater than VOS1; when Va-Vb is less than VOS1, Vout is the low voltage VL. Compared to a voltage comparator whose input offset voltage is 0, the duration in which the voltage comparator outputs the high voltage VH is decreased by Δt1, and the duration in which the voltage comparator outputs the low voltage VL is increased by Δt1 for the voltage comparator corresponding to FIG. 8*a*.

Figure 9B:
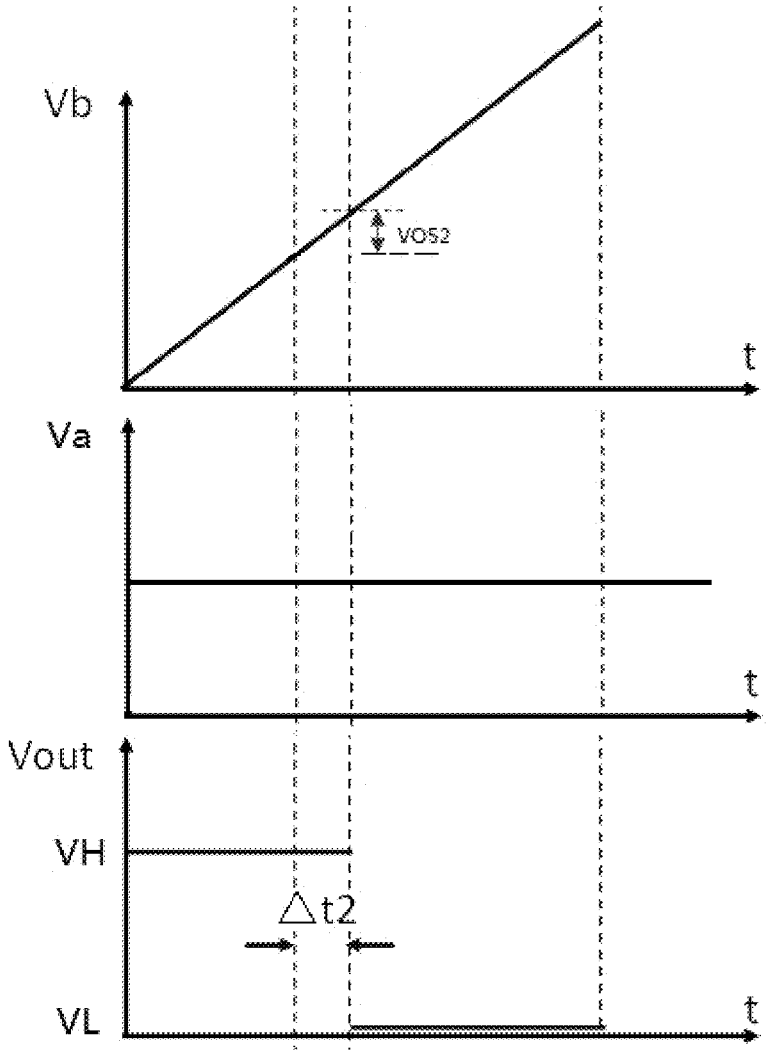
FIG. 9*b* is a schematic diagram illustrating an input offset voltage of the voltage comparator whose voltage transfer curve is shown in FIG. 8*b;*

As shown in FIG. 9*b*, for the voltage comparator corresponding to FIG. 8*b* (i.e. sample 2), VOS2 is less than 0, and Vout is the high voltage VH when Va-Vb is greater than VOS2; when Va-Vb is less than VOS2, Vout is the low voltage VL. Compared to the voltage comparator whose input offset voltage is 0, the duration in which the voltage comparator outputs the high voltage VH is increased by Δt2, and the duration in which the voltage comparator outputs the low voltage VL is decreased by Δt2 for the voltage comparator corresponding to FIG. 8*b*.

In FIG. 9*a* and FIG. 9*b*, the horizontal axes represent time t.

It can be found that the duration in which the voltage comparator corresponding to FIG. 8*a* (i.e. sample 1) outputs the low voltage is different from the duration in which the voltage comparator corresponding to FIG. 8*b* (i.e. sample 2) outputs the low voltage, and thus the difference in the turned-on durations of the switch control transistors controlled by the output terminals of the two voltage comparators is Δt1+Δt2, that is, the difference in the illumination times of the two corresponding light emitting elements is Δt1+Δt2, resulting in poor display quality. Therefore, the input offset voltages of the voltage comparators at different positions on the glass substrate need to be detected and then compensated at the data line Data.

After obtaining the input offset voltages, the input offset voltages can be compensated by adjusting the data voltages in the pixel circuits at different positions on the glass substrate to adjust the voltage input to the non-inverting input terminal of the voltage comparator.

Figure 10A:
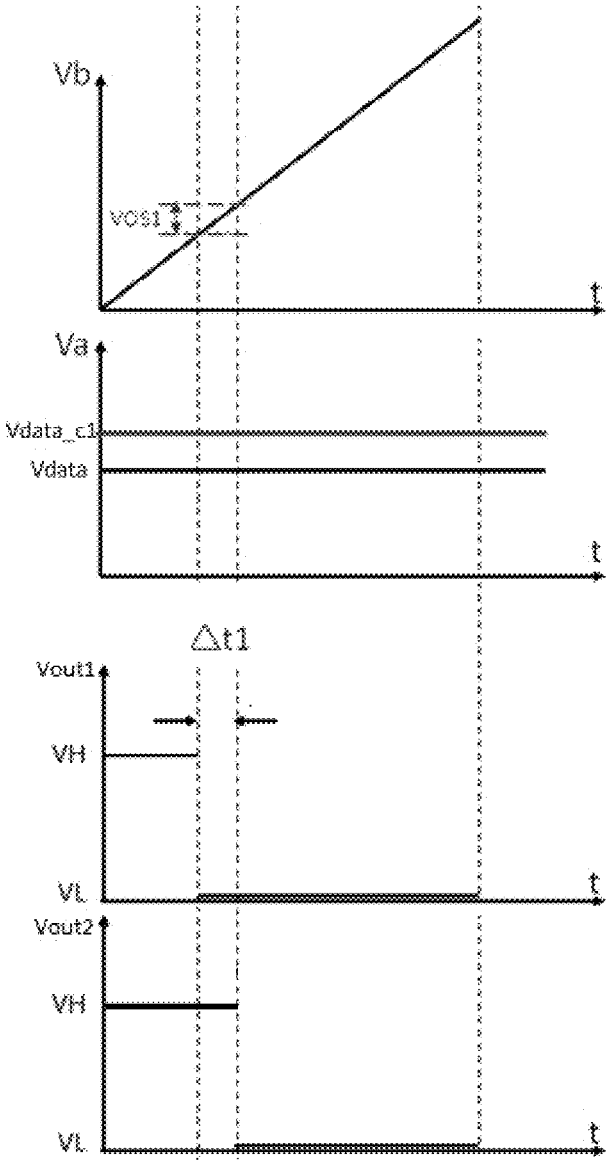
FIG. 10*a* is an operation timing chart when data voltage compensation is performed with the voltage comparator whose voltage transfer curve is shown in FIG. 8*a;*
Figure 10B:
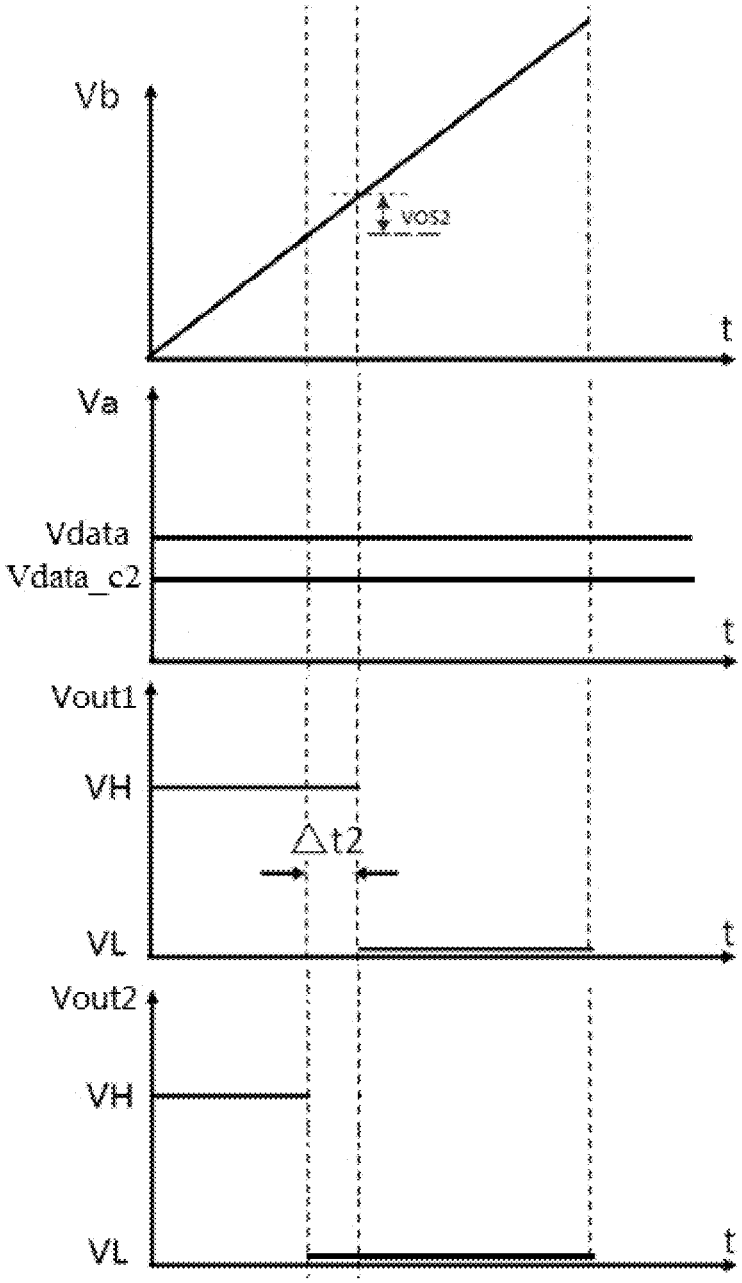
FIG. 10*b* is an operation timing chart when data voltage compensation is performed with the voltage comparator whose voltage transfer curve is shown in FIG. 8*b*.

FIG. 10*a* and FIG. 10*b* illustrates data voltage compensation performed on the two voltage comparators, i.e. sample 1 and sample 2. In FIG. 10*a* and FIG. 10*b*, the horizontal axes represent time t.

As shown in FIG. 10*a*, for sample 1, VOS1 is greater than 0, and the data voltage is increased from Vdata to the first compensated data voltage Vdata_c1, and ideally, Vdata_c1−Vdata=VOS1.

In FIG. 10*a*, Vout1 is the voltage output from the voltage comparator before data voltage compensation; and Vout2 is the voltage output from the voltage comparator after data voltage compensation.

As shown in FIG. 10*b*, for sample 2, VOS2 is less than 0, and the data voltage is reduced from Vdata to the second compensated data voltage Vdata_c2, and ideally, Vdata_c2−Vdata=VOS2.

In FIG. 10*b*, Vout1 is the voltage output by the voltage comparator before data voltage compensation; and Vout2 is the voltage output by the voltage comparator after data voltage compensation.

After data voltage compensation, the durations in which the two voltage comparators output VL are the same, and thus the turned-on durations of the switch control transistors controlled by the output terminals of the two voltage comparators are the same. Accordingly, the illumination times of the two corresponding light emitting elements are the same, achieving uniformity of brightness.

Figure 11:
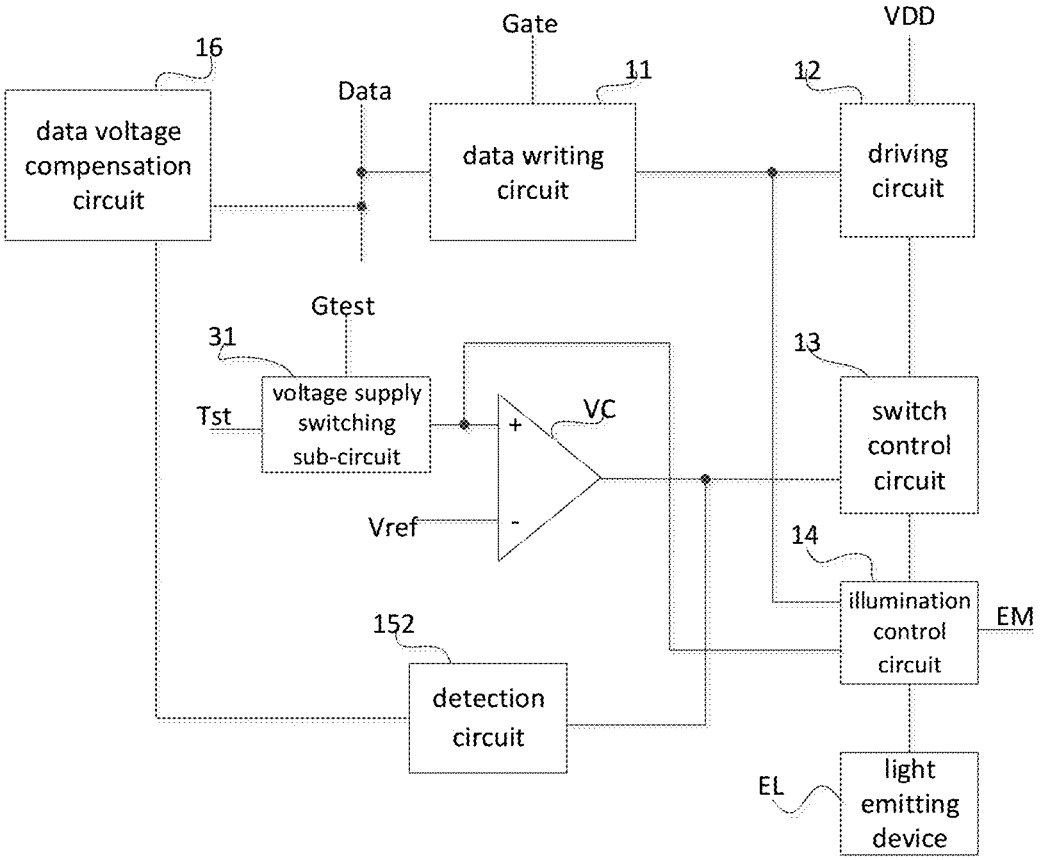
FIG. 11 is a structural diagram of a pixel circuit according to an embodiment.

On the basis of the pixel circuit shown in FIG. 2, in the pixel circuit shown in FIG. 11, the test voltage supplying circuit may include a voltage supply switching sub-circuit 31. The voltage supply switching sub-circuit 31 is electrically connected to the test control terminal Gtest, the test voltage terminal Tst and the non-inverting input terminal of the voltage comparator VC, respectively, for controlling the connection between the test voltage terminal Tst and the non-inverting input terminal of the voltage comparator VC under the control of the test control signal input by the test control terminal Gtest.

When the pixel circuit shown in FIG. 11 is in operation, during the detection period, under the control of the test control signal input by the test control terminal Gtest, the voltage supply switching sub-circuit 31 controls the test voltage terminal Tst to connect to the non-inverting input terminal of the voltage comparator VC, and the test voltage terminal Tst is input with the corresponding DC test voltage Vtest. The voltage supply switching sub-circuit 31 supplies Vtest to the non-inverting input terminal of the voltage comparator VC, and the voltage comparator VC compares the DC test voltage Vtest and the reference voltage Vref. The input offset voltage of the voltage comparator VC is obtained according to the voltages output by the voltage comparator VC. During the detection period, the DC test voltage Vtest may be changed multiple times in order to obtain multiple sets of voltages output by the voltage comparator VC, and the input offset voltage of the voltage comparator VC may be obtained by plotting the voltage transfer curve.

Figure 12:
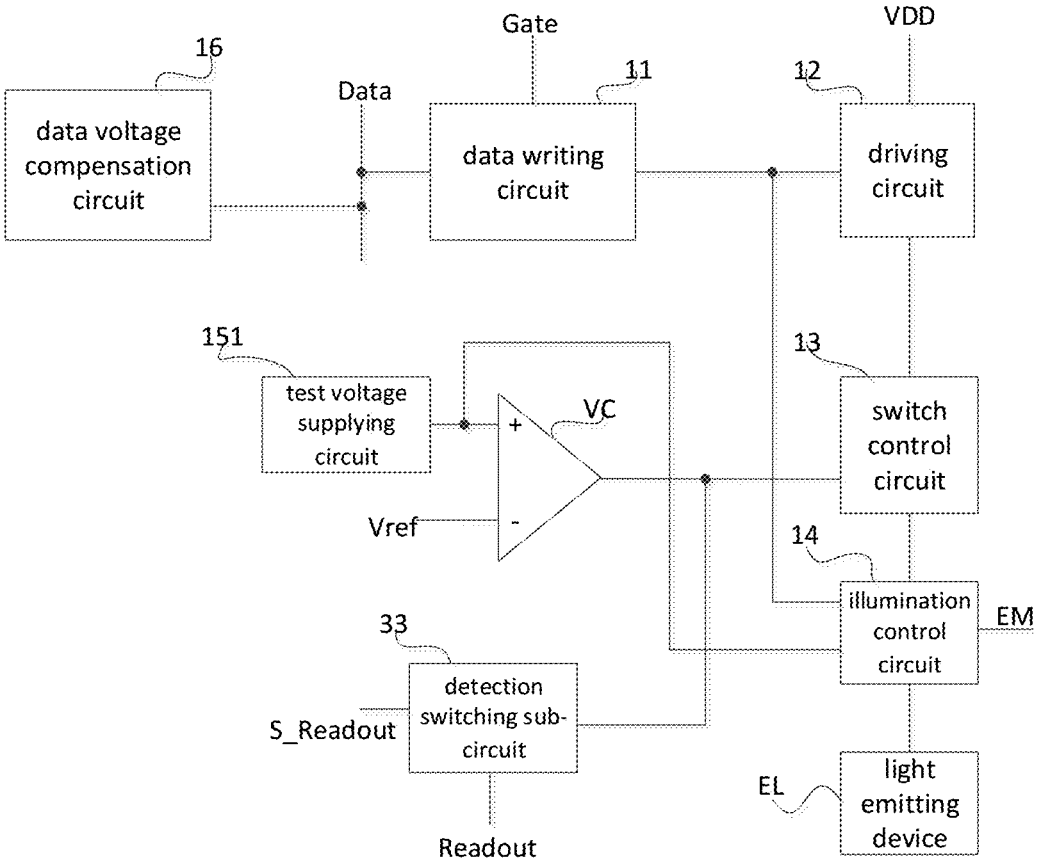
FIG. 12 is a structural diagram of a pixel circuit according to an embodiment.

On the basis of the pixel circuit shown in FIG. 2, in the pixel circuit shown in FIG. 12, the detection circuit may include a detection switching sub-circuit 33. The detection switching sub-circuit 33 is electrically connected to the detection switching control terminal S_Readout, the output terminal of the voltage comparator VC, and the read line Readout, respectively, for controlling a connection between the output terminal of the voltage comparator VC and the read line Readout under the control of the detection switching control signal input by the detection switching control terminal S_Readout. For example, the voltage output by the voltage comparator VC is supplied to the read line Readout through the output terminal of the voltage comparator VC under the control of the detection switching control signal input by the detection switching control terminal S_Readout, and then this voltage output by the voltage comparator VC may be supplied to a detection sub-circuit 34 (not shown in FIG. 12) through the read line Readout to obtain the input offset voltage of the voltage comparator VC. After the input offset voltage of the voltage comparator VC is obtained, it is supplied to the data voltage compensation circuit 16 to obtain the compensated data voltage. The data voltage compensation circuit 16, for example, may be an application specific integrated circuit, or it may include programmable logic arrays or microcontrollers appropriately programmed or other hardware devices that obtain the compensated data voltage according to the input offset voltage and supply the compensated data voltage to the data line.

When the pixel circuit shown in FIG. 12 is in operation, during the detection period, under the control of the detection switching control signal input by the detection switching control terminal S_Readout, the detection switching sub-circuit 33 controls the output terminal of the voltage comparator VC to connect to the read line Readout such that the voltage output by the voltage comparator VC is supplied to the read line Readout through its output terminal and the detection switching sub-circuit 33. The input offset voltage of the voltage comparator VC is obtained according to the voltages output by the voltage comparator VC; and after the input offset voltage is obtained, it is supplied to the data voltage compensation circuit 16. The data voltage compensation circuit 16 compensates the data voltage according to the input offset voltage to obtain the compensated data voltage, which is supplied to the data line Data.

According to an embodiment of the present disclosure, a driving method applied to the pixel circuit is provided. The driving method includes: detecting the input offset voltage of the voltage comparator in a detection period; and compensating the data voltage according to the input offset voltage to obtain a compensated data voltage in a display period. The detection period is configured before the display period; and the display period may include a data writing phase.

Figure 13:
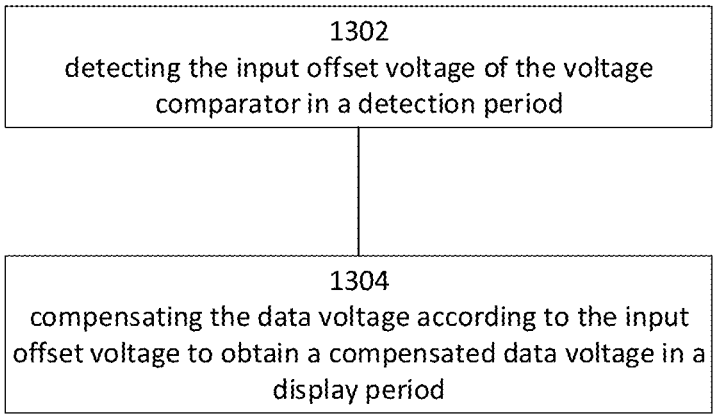
FIG. 13 is a flowchart of a driving method for the pixel circuit according to an embodiment.

As shown in FIG. 13, during the detection period, the offset voltage detecting circuit detects the input offset voltage of the voltage comparator 1302; and in the display period or more specifically, in the data writing phase, the data voltage compensation circuit compensates the data voltage according to the input offset voltage to obtain the compensated data voltage 1304. Thus, the pixel circuit according to the embodiment of the present disclosure can accurately control the on and off of the switch control circuit through the voltage comparator, thereby enabling accurate adjustment of the illumination time of the light emitting element.

In the embodiment of the present disclosure, after detecting the input offset voltage of the voltage comparator included in each pixel circuit, and performing data voltage compensation on each pixel circuit according to the corresponding input offset voltage, the light emitting durations of the pixel circuits at different positions on the display panel are the same when the same gray scale is displayed. Thus, the uniformity of the brightness of the display panel is increased, and the display effect is improved.

The step of detecting the input offset voltage of the voltage comparator in the detection period includes: providing a test voltage to a first input terminal of the voltage comparator; providing the reference voltage to the second input terminal of the voltage comparator; detecting output voltages of the voltage comparator; and obtaining the input offset voltage of the voltage comparator based on the output voltages.

The step of detecting the input offset voltage of the voltage comparator may further include: determining a voltage difference between the first input terminal of the voltage comparator and the second input terminal of the voltage comparator as the input offset voltage of the voltage comparator when the output voltage of the voltage comparator is a predetermined voltage, where the predetermined voltage is (VH+VL)/2, where VH is a high voltage output by the voltage comparator, and VL is a low voltage output by the voltage comparator.

In an example, the offset voltage detecting circuit of the pixel circuit may include a test voltage supplying circuit and a detection circuit. The test voltage supplying circuit provides the corresponding DC test voltage to the non-inverting terminal of the voltage comparator. The detection circuit detects a voltage outputted by the output terminal of the voltage comparator when the test voltage supplying circuit supplies the DC test voltage to the non-inverting input terminal; and the detection circuit determines a voltage difference between the non-inverting terminal of the voltage comparator and the inverting terminal of the voltage comparator as the input offset voltage of the voltage comparator when the output voltage of the voltage comparator is a predetermined voltage. The predetermined voltage may be (VH+VL)/2, where VH is a high voltage output by the voltage comparator, and VL is a low voltage output by the voltage comparator.

The step of compensating the data voltage according to the input offset voltage in the display period may include: adding the input offset voltage to the data voltage to obtain the compensated data voltage.

In an embodiment, the driving method may further include: in the detection period, the data writing circuit controls the data line to be disconnected from the control terminal of the driving circuit under the control of the gate driving signal; and the illumination control circuit controls the second terminal of the switch control circuit to be disconnected from the light emitting element under the control of the illumination control signal, and controls the control terminal of the driving circuit to be disconnected from the first input terminal of the voltage comparator.

In an embedment, the display period may further include an illumination phase after the data writing phase; and the driving method further includes: in the data writing phase, the data writing circuit, under the control of the gate driving signal, writes the compensated data voltage to the control terminal of the driving circuit and controls the potential at the control terminal of the driving circuit; in the light emitting phase or the illumination phase, the reference voltage terminal inputs the reference voltage, and the driving circuit controls the connection between the power supply voltage terminal and the first terminal of the switch control circuit under the control of the potential at the control terminal of the driving circuit; the illumination control circuit controls the connection between the second terminal of the switch control circuit and the light emitting element under the control of the illumination control signal input by the illumination control line, and controls the connection between the control terminal of the driving circuit and the first input terminal of the voltage comparator; the voltage comparator outputs the control voltage signal according to the voltage at the first input terminal and the reference voltage; and the switch control circuit controls the connection or disconnection between the first terminal of the switch control circuit and the second terminal of the switch control circuit under the control of the control voltage signal.

In an example, in the light emitting phase, the offset voltage detecting circuit stops detecting the offset voltage of the voltage comparator. The reference voltage terminal inputs the reference voltage, and the driving circuit controls the connection between the power supply voltage terminal and the first terminal of the switch control circuit under the control of the potential at the control terminal thereof. The illumination control circuit controls the connection between the second terminal of the switch control circuit and the light emitting element under the control of the illumination control signal input by the illumination control line, and controls the connection between the control terminal of the driving circuit and the non-inverting input terminal of the voltage comparator. The voltage comparator outputs the control voltage signal according to the voltage at the non-inverting input terminal and the reference voltage. The switch control circuit controls the connection or disconnection between the first terminal of the switch control circuit and the second terminal of the switch control circuit under the control of the control voltage signal to control the illumination time of the light emitting element.

In the light emitting phase, the value of the current flowing through the light emitting element is related to the compensated data voltage, and the illumination time of the light emitting element is related to the reference voltage and the compensated data voltage.

In the embodiment, after detecting the input offset voltage of the voltage comparator included in each pixel circuit, and performing data voltage compensation on each pixel circuit according to the input offset voltage, the light emitting durations of the pixel circuits at different positions on the display panel are the same when the same gray scale is displayed. Thus, the uniformity of the brightness of the display panel is increased, and the display effect is improved.

According to an embodiment of the present disclosure, a display panel or a display device including the pixel circuit is provided.

The display device may be any product or component having a display function such as a mobile phone, a tablet computer, a television, a monitor, a notebook computer, a digital photo frame, a navigator or the like.

Various embodiments and/or examples are disclosed to provide exemplary and explanatory information to enable a person of ordinary skill in the art to put the disclosure into practice. Features or components disclosed with reference to one embodiment or example are also applicable to all embodiments or examples unless specifically indicated otherwise.

Although the disclosure is described in combination with specific embodiments, it is to be understood by the person skilled in the art that many changes and modifications may be made and equivalent replacements may be made to the components without departing from a scope of the disclosure. Embodiments may be practiced in other specific forms. The described embodiments are to be considered in all respects only as illustrative and not restrictive.

The invention claimed is:

1. A pixel circuit, comprising:

a light emitting device having a first terminal and a second terminal;

a driving circuit, electrically connected to the first terminal of the light emitting device, for providing power to the light emitting device;

a voltage comparator for generating a pulse width modulated signal having a duty cycle based on a data voltage and a reference voltage;

an offset voltage detecting circuit, electrically connected to an output terminal of the voltage comparator, for detecting an input offset voltage of the voltage comparator;

a data voltage compensation circuit, electrically connected to the offset voltage detecting circuit, for compensating the data voltage according to the input offset voltage detected; and a data writing circuit electrically connected to a data line and the driving circuit, an illumination control circuit electrically connected to the light emitting device, and a switch control circuit electrically connected to the driving circuit and the output terminal of the voltage comparator, wherein:

the data writing circuit is configured to control writing the data voltage provided by the data line to a control terminal of the driving circuit under control of a gate driving signal input by a gate line, and to control a potential at the control terminal of the driving circuit;

the switch control circuit is configured to control a connection between a first terminal of the switch control circuit and a second terminal of the switch control circuit under control of a potential at a control terminal of the switch control circuit; and the illumination control circuit is configured to control a connection between the second terminal of the switch control circuit and the light emitting device under control of an illumination control signal input by an illumination control line, and to control a connection between the control terminal of the driving circuit and a first input terminal of the voltage comparator.

2. The pixel circuit according to claim 1, wherein the offset voltage detecting circuit comprises:

a test voltage supplying circuit, electrically connected to a first input terminal of the voltage comparator, for providing a test voltage to the first input terminal of the voltage comparator; and a detection circuit, electrically connected to the output terminal of the voltage comparator, for detecting output voltages of the voltage comparator to obtain the input offset voltage of the voltage comparator when the test voltage is provided to the first input terminal of the voltage comparator and the reference voltage is provided to a second input terminal of the voltage comparator.

3. The pixel circuit according to claim 2, wherein the test voltage supplying circuit comprises a voltage supply switching sub-circuit for controlling a connection between a test voltage terminal and the first input terminal of the voltage comparator under control of a test control signal input by a test control terminal.

4. The pixel circuit according to claim 3, wherein the voltage supply switching sub-circuit comprises a voltage supply switching transistor; and wherein a control electrode of the voltage supply switching transistor is electrically connected to the test control terminal, a first electrode of the voltage supply switching transistor is electrically connected to the test voltage terminal, and a second electrode of the voltage supply switching transistor is electrically connected to the first input terminal of the voltage comparator.

5. The pixel circuit according to claim 3, wherein the test voltage supplying circuit further comprises a voltage supplying sub-circuit for providing a test voltage to the test voltage terminal.

6. The pixel circuit according to claim 2, wherein the detection circuit comprises a detection switching sub-circuit for controlling a connection between an output terminal of the voltage comparator and a read line under control of a detection switching control signal input by a detection switching control terminal.

7. The pixel circuit according to claim 6, wherein the detection switching sub-circuit comprises a detection switching transistor; and wherein a control electrode of the detection switching transistor is electrically connected to the detection switching control terminal, a first electrode of the detection switching transistor is electrically connected to the read line, and a second electrode of the detection switching transistor is electrically connected to the output terminal of the voltage comparator.

8. The pixel circuit according to claim 6, wherein the detection circuit further comprises a detection sub-circuit electrically connected to the read line, for obtaining the input offset voltage of the voltage comparator based on the output voltages of the voltage comparator.

9. The pixel circuit according to claim 1, wherein the data voltage compensation circuit is configured to add the input offset voltage to the data voltage to obtain a compensated data voltage.

10. The pixel circuit according to claim 1, wherein the driving circuit is configured to control a connection between a power supply voltage terminal and the first terminal of the switch control circuit under control of the potential at the control terminal of the driving circuit; and a second input terminal of the voltage comparator is electrically connected to a reference voltage terminal providing the reference voltage, the output terminal of the voltage comparator is electrically connected to the control terminal of the switch control circuit, and the voltage comparator generates the pulse width modulated signal based on the data voltage provided to the first input terminal of the voltage comparator and the reference voltage.

11. The pixel circuit according to claim 1, wherein the switch control circuit comprises a switch control transistor, and the illumination control circuit comprises a first illumination control transistor and a second illumination control transistor;

wherein a control electrode of the switch control transistor is electrically connected to the output terminal of the voltage comparator, a first electrode of the switch control transistor is electrically connected to the driving circuit, and a second electrode of the switch control transistor is electrically connected to a first electrode the second illumination control transistor;

a control electrode of the first illumination control transistor is electrically connected to the illumination control line, a first electrode of the first illumination control transistor is electrically connected to the control terminal of the driving circuit, and a second electrode of the first illumination control transistor is electrically connected to the first input terminal of the voltage comparator; and a control electrode of the second illumination control transistor is electrically connected to the illumination control line, and a second electrode of the second illumination control transistor is electrically connected to the light emitting device.

12. The pixel circuit according to claim 1, wherein the data writing circuit comprises a data writing transistor and a storage capacitor, and the driving circuit comprises a driving transistor;

wherein a control electrode of the data writing transistor is electrically connected to the gate line, a first electrode of the data writing transistor is electrically connected to the data line, and a second electrode of the data writing transistor is electrically connected a control electrode of the driving transistor;

a first terminal of the storage capacitor is electrically connected to the control electrode of the driving transistor, and a second terminal of the storage capacitor is electrically connected to a first voltage terminal; and the control electrode of the driving transistor is the control terminal of the driving circuit, a first electrode of the driving transistor is electrically connected to a power supply voltage terminal, and a second electrode of the driving transistor is electrically connected to the first terminal of the switch control circuit.

13. A driving method for the pixel circuit according to claim 1, comprising:

detecting the input offset voltage of the voltage comparator in a detection period; and compensating the data voltage according to the input offset voltage to obtain the compensated data voltage in a display period;

wherein, in the detection period, the data line is disconnected from the control terminal of the driving circuit under the control of the gate driving signal; the second terminal of the switch control circuit is disconnected from the light emitting device under the control of the illumination control signal; and the control terminal of the driving circuit is disconnected from the first input terminal of the voltage comparator under the control of the illumination control signal.

14. A display panel comprising the pixel circuit according to claim 1.

15. A display device comprising the display panel according to claim 14.

16. A driving method for a pixel circuit, the pixel circuit comprising a light emitting device having a first terminal and a second terminal; a driving circuit, electrically connected to the first terminal of the light emitting device, for providing power to the light emitting device; a voltage comparator for generating a pulse width modulated signal having a duty cycle based on a data voltage and a reference voltage; an offset voltage detecting circuit, electrically connected to an output terminal of the voltage comparator, for detecting an input offset voltage of the voltage comparator; a data voltage compensation circuit, electrically connected to the offset voltage detecting circuit, for compensating the data voltage according to the input offset voltage detected; a data writing circuit electrically connected to a data line and the driving circuit, an illumination control circuit electrically connected to the light emitting device, and a switch control circuit electrically connected to the driving circuit and the output terminal of the voltage comparator, the driving method comprising:

detecting the input offset voltage of the voltage comparator in a detection period; and compensating the data voltage according to the input offset voltage to obtain a compensated data voltage in a display period, wherein:

the data writing circuit is configured to control writing the data voltage provided by the data line to a control terminal of the driving circuit under control of a gate driving signal input by a gate line, and to control a potential at the control terminal of the driving circuit;

the switch control circuit is configured to control a connection between a first terminal of the switch control circuit and a second terminal of the switch control circuit under control of a potential at a control terminal of the switch control circuit; and the illumination control circuit is configured to control a connection between the second terminal of the switch control circuit and the light emitting device under control of an illumination control signal input by an illumination control line, and to control a connection between the control terminal of the driving circuit and a first input terminal of the voltage comparator.

17. The driving method according to claim 16, wherein detecting the input offset voltage of the voltage comparator in the detection period comprises:

providing a test voltage to a first input terminal of the voltage comparator;

providing the reference voltage to a second input terminal of the voltage comparator;

detecting output voltages of the voltage comparator; and obtaining the input offset voltage of the voltage comparator based on the output voltages.

18. The driving method according to claim 17, wherein detecting the input offset voltage of the voltage comparator further comprises:

determining a voltage difference between the first input terminal of the voltage comparator and the second input terminal of the voltage comparator as the input offset voltage of the voltage comparator when the output voltage of the voltage comparator is a predetermined voltage, wherein the predetermined voltage is (VH+VL)/2, where VH is a high voltage output by the voltage comparator, and VL is a low voltage output by the voltage comparator.

19. The driving method according to claim 16, wherein compensating the data voltage according to the input offset voltage in the display period comprises:

adding the input offset voltage to the data voltage to obtain the compensated data voltage.

* * * * *